US009427070B1

(12) United States Patent
Bastian et al.

(10) Patent No.: US 9,427,070 B1
(45) Date of Patent: Aug. 30, 2016

(54) APPARATUS AND METHOD FOR SUPPORTING AND OPERATING AN ELECTRONIC DEVICE UPON A USER'S CLOTHING OR BELT

(71) Applicants: James W. Bastian, Fargo, ND (US); Thomas W. Bastian, Tucson, AZ (US)

(72) Inventors: James W. Bastian, Fargo, ND (US); Thomas W. Bastian, Tucson, AZ (US)

( * ) Notice: Subject to any disclaimer, the term of this patent is extended or adjusted under 35 U.S.C. 154(b) by 0 days.

(21) Appl. No.: 14/680,133

(22) Filed: Apr. 7, 2015

(51) Int. Cl.
*A45F 5/02* (2006.01)

(52) U.S. Cl.
CPC ..... *A45F 5/02* (2013.01)

(58) Field of Classification Search
CPC .... A45F 5/02; A45F 5/021; A45F 2005/025; A45F 2200/05; A45F 2200/0508; A45F 2200/0516
See application file for complete search history.

(56) References Cited

U.S. PATENT DOCUMENTS 2,297,806 A * 10/1942 Smith ..... B43K 23/002 131/256
4,265,002 A * 5/1981 Hosken ..... A41F 1/002 24/303
4,982,581 A * 1/1991 Furuyama ..... A44C 17/0216 24/303
5,895,018 A * 4/1999 Rielo ..... A47K 10/12 248/206.5
6,282,760 B1 * 9/2001 Mars ..... A44B 9/16 24/303
6,888,940 B1 * 5/2005 Deppen ..... B60R 11/0241 379/446
7,374,142 B2 * 5/2008 Carnevali ..... F16M 11/04 224/183
8,328,055 B1 * 12/2012 Snyder ..... A45F 5/00 224/197
8,464,377 B1 * 6/2013 Carson ..... A47G 9/02 24/303
8,662,362 B1 * 3/2014 Bastian ..... H04B 1/3888 224/197
8,752,252 B2 * 6/2014 Ninomiya ..... H01F 7/0263 24/303
8,936,222 B1 * 1/2015 Bastian ..... A45F 5/00 224/183
2001/0035445 A1 * 11/2001 Kamiya ..... A45F 5/02 224/271
2003/0000976 A1 * 1/2003 Malhotra ..... A45F 5/00 224/197
2004/0069916 A1 * 4/2004 Cohen ..... G09F 7/04 248/230.8
2005/0082323 A1 * 4/2005 O'Hair ..... A45C 1/04 224/219

* cited by examiner

*Primary Examiner* — Brian D Nash
(74) *Attorney, Agent, or Firm* — Dave Alan Lingbeck

(57) ABSTRACT

An apparatus and method for supporting and operating an electronic device upon a user's clothing or belt for safeguarding the phone and providing immediate and convenient functional access to the phone. The apparatus and method for supporting and operating an electronic device upon a user's clothing or belt includes a clip assembly adapted to clip onto a clothing or belt worn by a user; and a connector assembly including a magnet attached to the clip assembly and also including a metal plate having an outer side and adapted to be attached to an electronic device and magnetically and removably attached to the magnet for supporting the electronic device upon the clip assembly.

5 Claims, 3 Drawing Sheets

APPARATUS AND METHOD FOR SUPPORTING AND OPERATING AN ELECTRONIC DEVICE UPON A USER'S CLOTHING OR BELT

BACKGROUND OF THE INVENTION

1. Field of the Invention

The present invention relates to clothing or belt clips and more particularly pertains to a new apparatus and method for magnetically supporting an electronic device upon a user's clothing or belt for safeguarding the phone and providing immediate and convenient functional access to the phone.

2. Description of the Prior Art

The use of clothing or belt clips is known in the prior art. More specifically, clothing or belt clips heretofore devised and utilized are known to consist basically of familiar, expected and obvious structural configurations, notwithstanding the myriad of designs encompassed by the crowded prior art which have been developed for the fulfillment of countless objectives and requirements.

The prior art includes a wrist-device which comprising a first module such as a personal computer and a second module consisting of a mobile telephone or a wireless telephone terminal which are coupled by means of elements in a bracelet configuration for holding the device to the forearm of the user, and wherein windows are provided in said modules for the passage of electronic connection buses between said modules. Another prior art includes a generally rectangular holder base and a holder configured to secure the mobile device therein. The holder may be removably attachable to the holder base. Another prior art includes an arm harness with a control panel for operating multiple electronic devices contained by the arm harness. In addition, another prior art includes a cell phone holder headband which enables the phone to stay in a normal talking position without having to hold it there with one hand. The cell phone is fit into an elastic band that is looped through a plastic plate. The plate is fitted to a swivel joint that is connected to one end of the headband. Yet, another prior art includes a releasable holder for a portable communication device including a base clip adapted to secure to a carrier such as a clothing or belt and an article clip adapted to secure to the portable communication device. The base clip includes a channel having a bottom and side walls extending between open opposite ends with overlying flanges on both side walls spaced a selected distance from the channel bottom, and a locking tab extending into an opening in the channel bottom, a biasing member biasing the locking tab into the channel bottom opening. While these devices fulfill their respective, particular objectives and requirements, the aforementioned patents do not disclose a new apparatus and method for magnetically supporting a phone upon a user's arm.

SUMMARY OF THE INVENTION

The general purpose of the present invention, which will be described subsequently in greater detail, is to provide a new apparatus and method for magnetically supporting an electronic device upon a users'sclothing or belt which has many of the advantages of the clothing or belt clips mentioned heretofore and many novel features that result in a new apparatus and method for magnetically supporting an electronic device upon a user's a clothing or belt which is not anticipated, rendered obvious, suggested, or even implied by any of the prior art clothing or belt clips, either alone or in any combination thereof. The present invention may include a clip assembly adapted to clip onto a clothing or belt worn by a user; and a connector assembly including a magnet attached to the clip assembly and also including a metal plate having an outer side and adapted to be attached to an electronic device and magnetically and removably attached to the magnet for supporting the electronic device upon the clip assembly. None of the prior art includes the combination of the elements of the present invention.

There has thus been outlined, rather broadly, the more important features of the apparatus and method for magnetically supporting an electronic device upon a user's clothing or belt in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new apparatus and method for magnetically supporting an electronic device upon a user's clothing or belt which has many of the advantages of the clothing or belt clips mentioned heretofore and many novel features that is not anticipated, rendered obvious, suggested, or even implied by any of the prior art clothing or belt clips, either alone or in any combination thereof.

Still another object of the present invention is to provide a new apparatus and method tor magnetically supporting an electronic device upon a user's clothing or belt for safeguarding the phone and providing immediate and convenient functional access to the phone.

Still yet another object of the present invention is to provide a new apparatus and method for magnetically supporting an electronic device upon a user's clothing or belt that allows the user to easily remove the phone from the clothing or belt clip for use and to easily reattach the phone to the clothing or belt clip.

These together with other objects of the invention along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
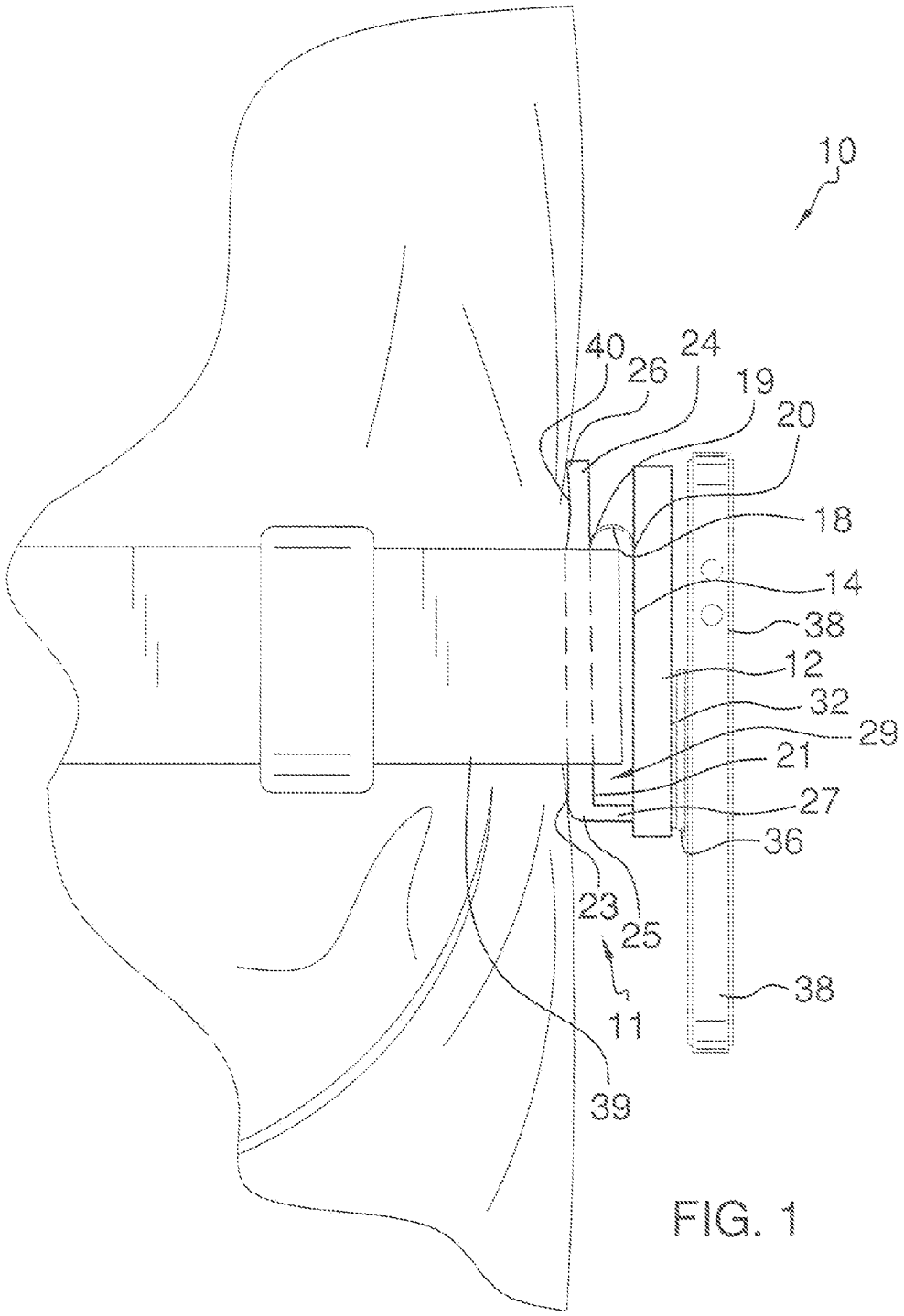
FIG. 1 is an end elevation view of a new apparatus for magnetically supporting an electronic device upon is user's clothing or belt according to the present invention with the electronic device magnetically attached to the clip assembly.
Figure 2:
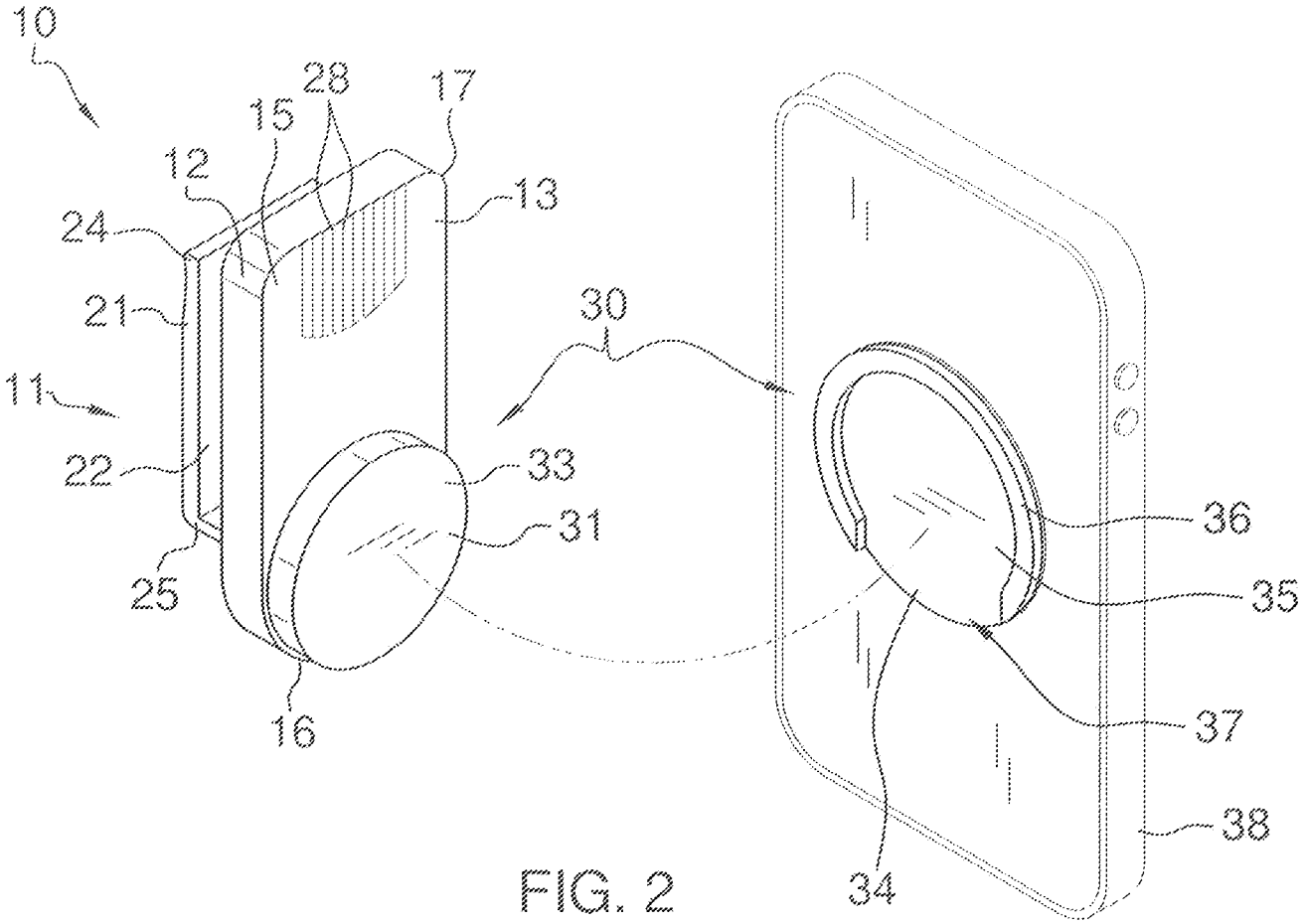
FIG. 2 is a perspective view of the clip with the back of the electronic device showing the metal plate and magnet retainer.
Figure 3:
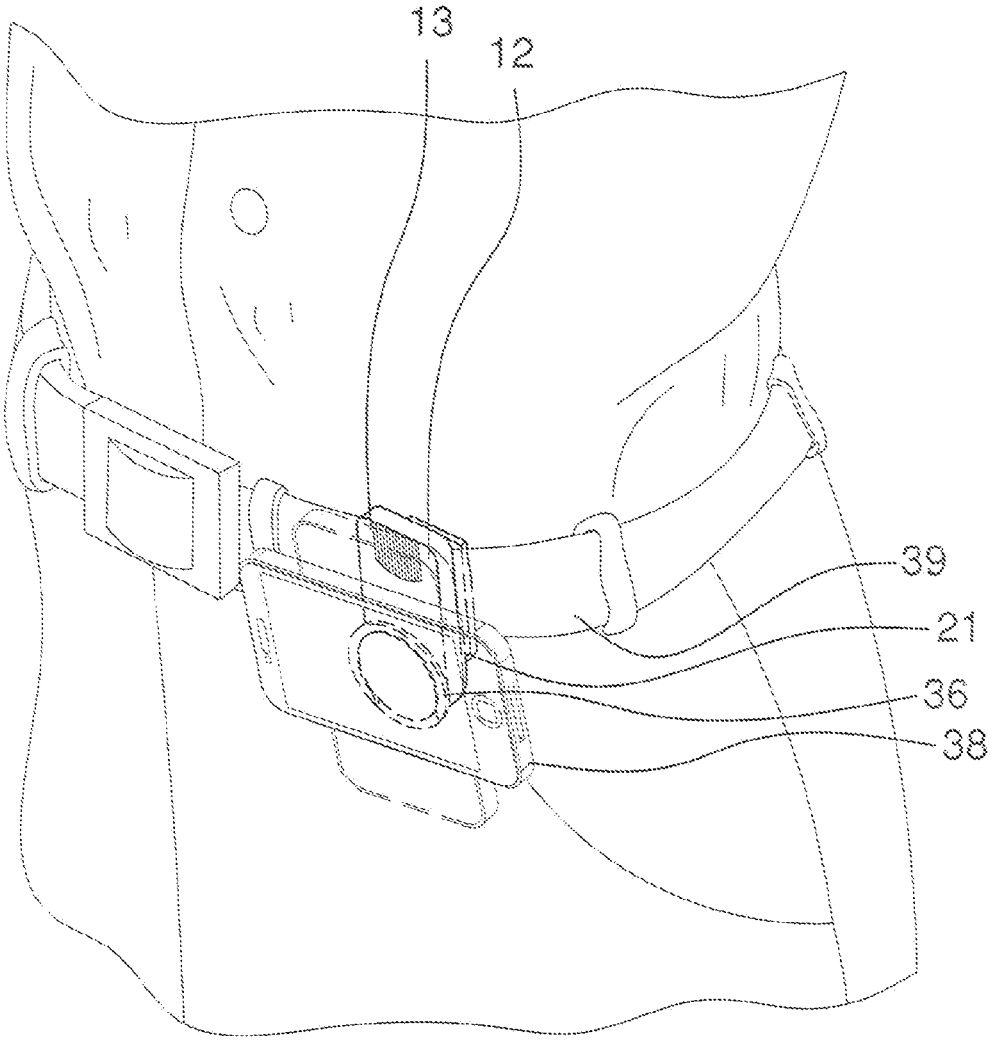
FIG. 3 is a perspective view of the clothing or belt clip on a user's clothing or belt with the electronic device attached to the clothing or belt clip.

With reference now to the drawings, and in particular to FIGS. 1 through 3 thereof, a new apparatus and method for magnetically supporting an electronic device upon a user's clothing or belt embodying the principles and concepts of the present invention and generally designated by the reference numeral 10 will be described.

As best illustrated in FIGS. 1 through 3, the apparatus and method for magnetically supporting an electronic device, upon a user's clothing or belt 10 generally may comprise a clip assembly 11 adapted to clip onto a clothing or belt 39 worn by a user; and a connector assembly 30 including a magnet 31 conventionally attached with adhesive to the clip assembly 11 and also including a metal plate 34 having an outer side 35 and adapted to be conventionally attached to an electronic device 38 and magnetically and removably attached to the magnet 31 for supporting the electronic device 38 upon the clip assembly 11.

As illustrated in FIGS. 1 through 3, the clip assembly 11 may include a planar support member 12, a biased element 18 conventionally coupled to the planar support member 12 and a lever 21 conventionally coupled to the biased element 18. The planar support member 12 may include a front side 13 facing away from the lever 21 and a back side 14 facing the lever 21 with the biased element 18 conventionally coupled to the back side 14 of the planar support member 12. The planar support member 12 may also have a top end 15, a bottom end 16, and a top end portion 17 with ribs 28 spaced apart on the top end portion 17 on the front side 13 of the planar support member 12 for a user to grasp to open the clip assembly 11. The biased element 18 may be a curved leaf spring having opposed ends 19, 20, one of which is conventionally coupled to the planar support member 12 and the other of which is conventionally coupled to the lever 21. The lever 21 may have a front side 22 facing the planar support member 12 with the biased element 18 conventionally coupled to the front side 22 of the lever 21 and may further have a back side 23. The lever 21 has a top end 24, bottom end 25 and a top end portion 26 with a depression 40 in the back side 23 of the lever 21 on the top end portion 26 for the user to grasp to open the clip assembly 11. The lever 21 may have an extension piece 27 integral to the front side 22 and at the bottom end 25 thereof and extending forwardly of the lever 21 towards the planar support member 12 and biasedly engaged with the planar support member 12. The biased element 18 may be curved away from the bottom ends 16, 25 of the planar support member 12 and the lever 21 to form a clothing or belt receiving slot 29 between the planar support member 12 and the lever 21.

As further shown in FIGS. 1 through 3, the magnet 31 may have a flat first side 32 securely and conventionally attached with adhesive flush against the front side 13 of the planar support member 12 and also may have a thickness with the magnet 31 protruding outwardly from the planar support member 12. The magnet 31 may have a flat second side 33 facing outwardly away from the planar support member 12. The connector assembly 30 may further include a magnet retainer 36 conventionally attached with adhesive to the metal plate 34 and removably disposed about the magnet 31 upon the electronic device 38 including a phone being magnetically supported upon the clip assembly 11 to restrict movement and prevent sliding of the electronic device 38 upon the clip assembly 11. The magnet retainer 36 may be a ring 36 having a dimension larger than that of the magnet 31 with the ring 36 conventionally and centrally attached to the metal plate 34 and extending outwardly from the outer side 35 of the metal plate 34 and spaced from a perimeter of the metal plate 34. The ring 36 may be an open ring 36 which is a C-shaped ring 36 having a narrow width. The flat second side 33 of the magnet 31 may be magnetically attached flush to the outer side 35 of the metal plate 34 with the ring 36 disposed about the magnet 31 upon the electronic device 38 being supported upon the clip assembly 11.

As shown in FIG. 3, in use the user may grasp and squeeze together the top end portions 17, 26 of the lever 21 and the planar support member 12 which urges the extension piece 27 away from the planar support member 12 to expose the belt-receiving slot 29 and then may move the clip assembly 11 to receive the clothing or belt 39 into the belt-receiving slot 29. The user then releases the lever 21 with the biased element 18 urging the extension piece 27 into engagement with the planar support member 12 to securely clip the clip assembly 11 to the clothing or belt 39 with the magnet 31 exposed away front the user's body. The metal plate 34 may be magnetically attached to the magnet 31 to support the electronic device 38. The magnet 31 may be received within the C-shaped ring 36 with the C-shaped ring 36 disposed about the magnet 31 to restrict movement of the electronic device 38 upon the clip assembly 11. The electronic device 38 may be removed from the clip assembly 11 as desired. The electronic device 38 may be slid along the clip assembly 11 with the magnet 31 moving through an opening 37 and out of the C-shaped ring 36.

As to a further discussion of the manner of usage and operation of the present invention, the same should be apparent front the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the apparatus and method for magnetically supporting a phone upon a user's arm. Further, since numerous modifications and changes will readily occur to those skilled in the art, it is not desired to limit the invention to the exact construction and operation shown and described, and accordingly, all suitable modifications and equivalents may be restored to, falling within the scope of the invention.

What is claimed is:

1. An apparatus for magnetically supporting an electronic device upon a user's clothing or belt comprising:

a clip assembly adapted to clip onto a clothing or belt worn by a user, wherein the clip assembly includes a planar support member, a biased element coupled to the planar support member and a lever coupled to the biased element, wherein the planar support member includes a front side facing away from the lever and a back side with the biased element coupled to the back side of the planar support member; and a connector assembly including a magnet attached to the clip assembly and also including a metal plate having an outer side and adapted to be attached to an electronic device and magnetically and removably attached to the magnet for supporting the electronic device upon the clip assembly, wherein the magnet has a flat first side securely attached flush against the front side of the planar support member and also has a thickness with the magnet protruding outwardly from the planar support member, wherein the magnet has a flat second side facing outwardly away from the planar support member, wherein the connector assembly further includes a magnet retainer attached to the metal plate and removably disposed about the magnet upon the electronic device being magnetically supported upon the clip assembly to restrict movement and prevent sliding of the electronic device upon the clip assembly, wherein the magnet retainer is a ring having a dimension larger than that of the magnet and centrally attached to the metal plate and extending outwardly from the outer side of the metal plate and spaced from a perimeter of the metal plate, wherein the ring is an open ring which is a C-shaped ring having a narrow width.

2. The apparatus for magnetically supporting an electronic device upon a user's clothing or belt as described in claim 1, wherein the flat second side of the magnet is magnetically attached flush to the outer side of the metal plate with the C-shaped ring disposed about the magnet upon the electronic device being supported upon the clip assembly.

3. A method for magnetically supporting an electronic device upon a user's clothing or belt comprising:

providing a clip assembly and a connector assembly including a magnet attached to the clip assembly, a metal plate attached to an electronic device and magnet retainer attached to the metal plate, wherein the clip assembly includes a planar support member having a front side with the magnet having a flat first side securely attached flush to the front side of the planar support member, wherein the magnet retainer is an open ring which is a C-shaped ring attached to and extending outwardly from the outer side of the metal plate and having a narrow width and spaced from a perimeter of the metal plate;

clipping the clip assembly upon a clothing or belt worn by a user;

magnetically attaching the metal plate to the magnet to support the electronic device; and removing the electronic device from the clip assembly as desired.

4. The method for magnetically supporting an electronic device upon a user's clothing or belt as described in claim 3, wherein the magnetically attaching the metal plate to the magnet includes receiving the magnet within the C-shaped ring with the ring disposed about the magnet to restrict movement of the electronic device upon the clip assembly.

5. The method for magnetically supporting an electronic device upon a user's clothing or belt as described in claim 4, wherein the removing the electronic device from the clip assembly includes sliding the electronic device upon the clothing or belt clip with the magnet moving through an opening and out of the C-shaped ring.

* * * * *